US010199764B2

(12) United States Patent
Wang

(10) Patent No.: US 10,199,764 B2
(45) Date of Patent: Feb. 5, 2019

(54) WATERPROOF ELECTRICAL CONNECTOR HAVING A SHIELDING SHELL WITH A STEPPED AND RECESSED STRUCTURE

(71) Applicant: FOXCONN INTERCONNECT TECHNOLOGY LIMITED, Grand Cayman (KY)

(72) Inventor: Cai-Yuan Wang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/599,892

(22) Filed: May 19, 2017

(65) Prior Publication Data

US 2017/0338585 A1 Nov. 23, 2017

(30) Foreign Application Priority Data

May 20, 2016 (CN) ..... 2016 1 0336120

(51) Int. Cl.

| | |
|---|---|
| ***H01R 13/6593*** | (2011.01) |
| ***H01R 13/52*** | (2006.01) |
| ***H01R 13/6585*** | (2011.01) |
| ***H01R 24/60*** | (2011.01) |
| ***H01R 43/00*** | (2006.01) |
| *H01R 4/28* | (2006.01) |
| *H01R 13/40* | (2006.01) |
| *H01R 107/00* | (2006.01) |

(52) U.S. Cl.

CPC ..... *H01R 13/5202* (2013.01); *H01R 13/5219* (2013.01); *H01R 13/6585* (2013.01); *H01R 24/60* (2013.01); *H01R 43/005* (2013.01); *H01R 4/28* (2013.01); *H01R 13/40* (2013.01); *H01R 2107/00* (2013.01)

(58) Field of Classification Search

CPC ... H01R 13/6594; H01R 4/28; H01R 13/5202
USPC ..... 439/607.41
See application file for complete search history.

(56) References Cited

U.S. PATENT DOCUMENTS

| | | | | |
|---|---|---|---|---|
| 9,391,391 | B2 * | 7/2016 | Chien | H01R 13/5202 |
| 9,444,177 | B2 | 9/2016 | Tsai et al. | |
| 2013/0065442 | A1 * | 3/2013 | Nagata | H01R 13/5202 439/607.58 |
| 2013/0183844 | A1 * | 7/2013 | Wang | H01R 24/68 439/271 |

(Continued)

FOREIGN PATENT DOCUMENTS

| | | | |
|---|---|---|---|
| CN | 204118373 | U | 1/2015 |
| CN | 204315813 | U | 5/2015 |
| CN | 204809520 | U | 11/2015 |

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

An electrical connector includes: an insulative housing having a rear base and a front tongue; an upper and lower rows of contacts mounted in the insulative housing and exposed to the tongue; a shielding shell enclosing the insulative housing; and a sealing element sealing a junction between the insulative housing and the shielding shell; wherein the shielding shell includes a rear step located immediately adjacent the junction and a recess at a corner of the step, and the base of the insulative housing includes a step fitting the rear step of the shielding shell.

18 Claims, 9 Drawing Sheets

(56) References Cited

U.S. PATENT DOCUMENTS

| | | | | |
|---|---|---|---|---|
| 2015/0325944 | A1* | 11/2015 | Chien | H01R 13/5202 439/271 |
| 2016/0104957 | A1 | 4/2016 | Kim et al. | |
| 2016/0164218 | A1* | 6/2016 | Lee | H01R 13/5202 439/587 |

* cited by examiner

WATERPROOF ELECTRICAL CONNECTOR HAVING A SHIELDING SHELL WITH A STEPPED AND RECESSED STRUCTURE

BACKGROUND OF THE INVENTION

1. Field of the Invention

The present invention relates to a waterproof electrical connector having a rear sealing element between an insulative housing and a shielding shell, and more particularly to a stepped and recessed structure of the shielding shell cooperating with the sealing element.

2. Description of Related Arts

China Patent No. 204118373, issued on Jan. 21, 2015, discloses a waterproof electrical connector having a main part, an outer metallic shell enclosing the main part, and a sealing element at a rear thereof between an outer periphery of the main part and an interior wall of the metallic shell. Specifically, the main part and the metallic shell have respective first and second annular grooves in fluid communication with each other, and the sealing element fills the first and second annular grooves.

SUMMARY OF THE INVENTION

An electrical connector comprises: an insulative housing having a rear base and a front tongue; an upper and lower rows of contacts mounted in the insulative housing and exposed to the tongue; a shielding shell enclosing the insulative housing; and a sealing element sealing a junction between the insulative housing and the shielding shell; wherein the shielding shell includes a rear step located immediately adjacent the junction and a recess at a corner of the step, and the base of the insulative housing includes a step fitting the rear step of the shielding shell.

DETAILED DESCRIPTION OF THE PREFERRED EMBODIMENT

Figure 1:
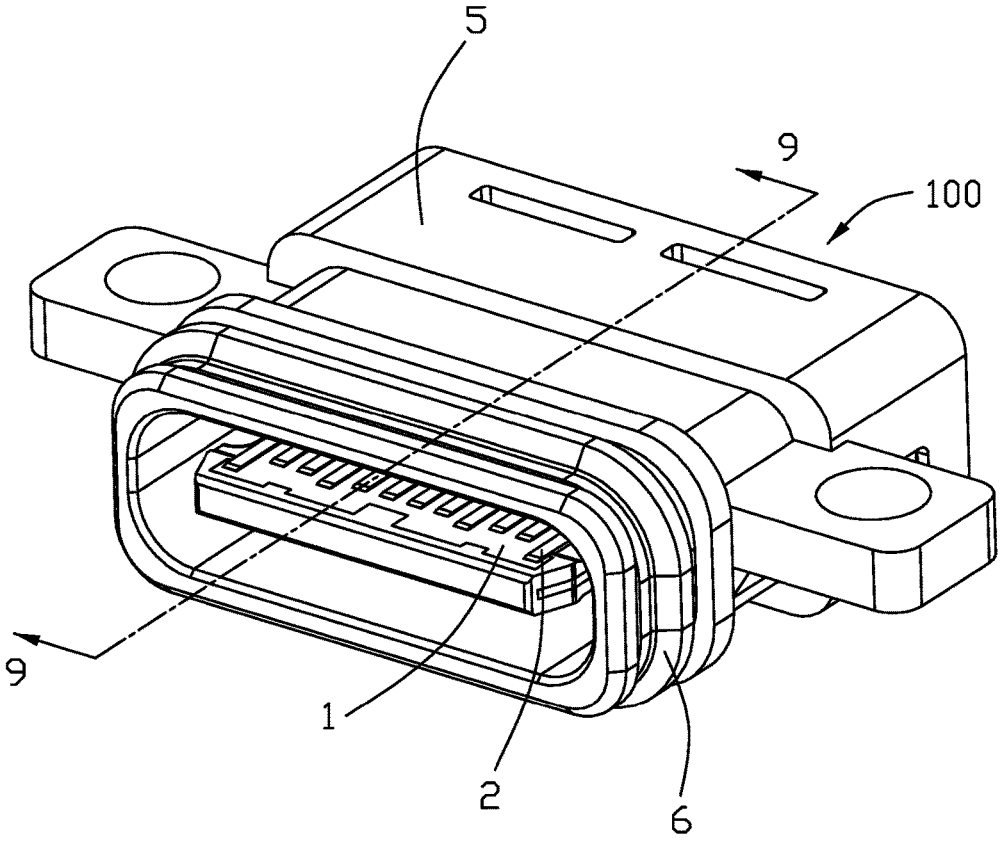
FIG. 1 is a perspective view of an electrical connector in accordance with the present invention.

Referring to FIGS. 1-8, an electrical connector 100 comprises an insulative housing 1, a plurality of contacts 2 mounted in the insulative housing 1, a shielding shell 5 enclosing the insulative housing 1, and a rear sealing element 4. The electrical connector 100 may further include a metallic plate 3 mounted in the insulative housing 1 and a front seal 6 mounted at an outer side of the shielding shell 5.

Figure 6:
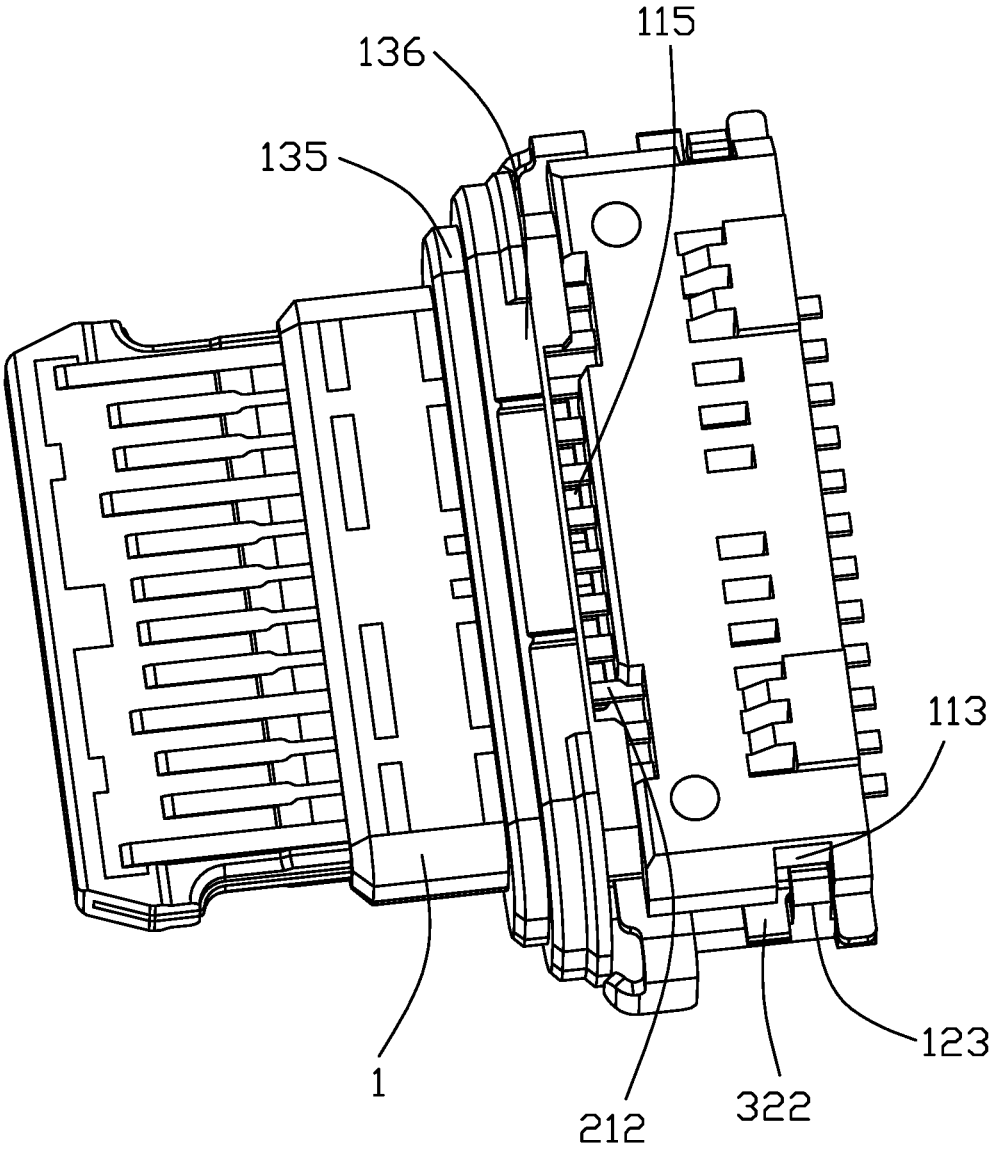
FIG. 6 is a perspective view showing an insulative housing, an upper and lower rows of contacts, and a metallic plate of the electrical connector of FIG. 1.
Figure 7:
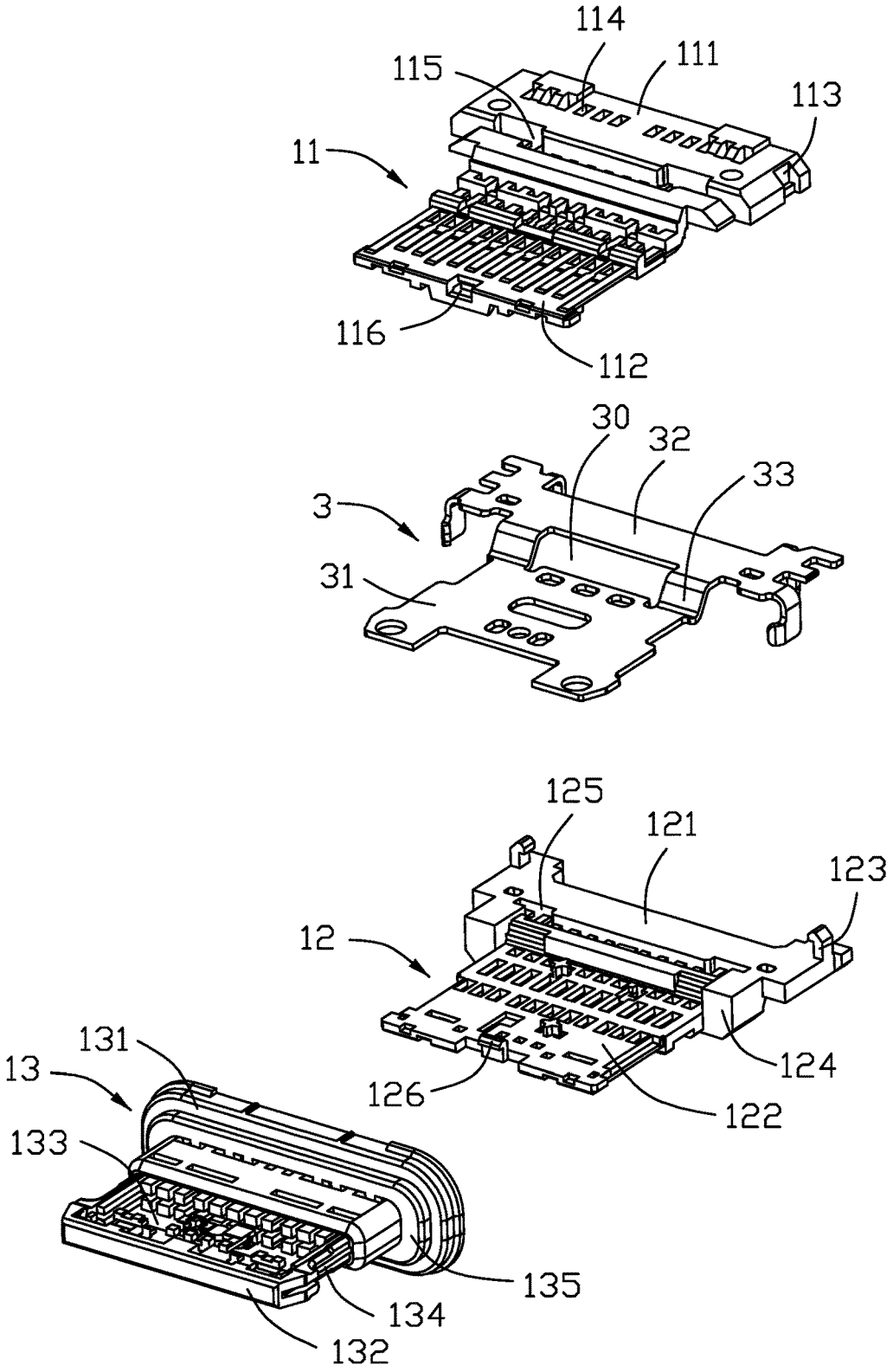
FIG. 7 is an exploded view of FIG. 6.
Figure 8:
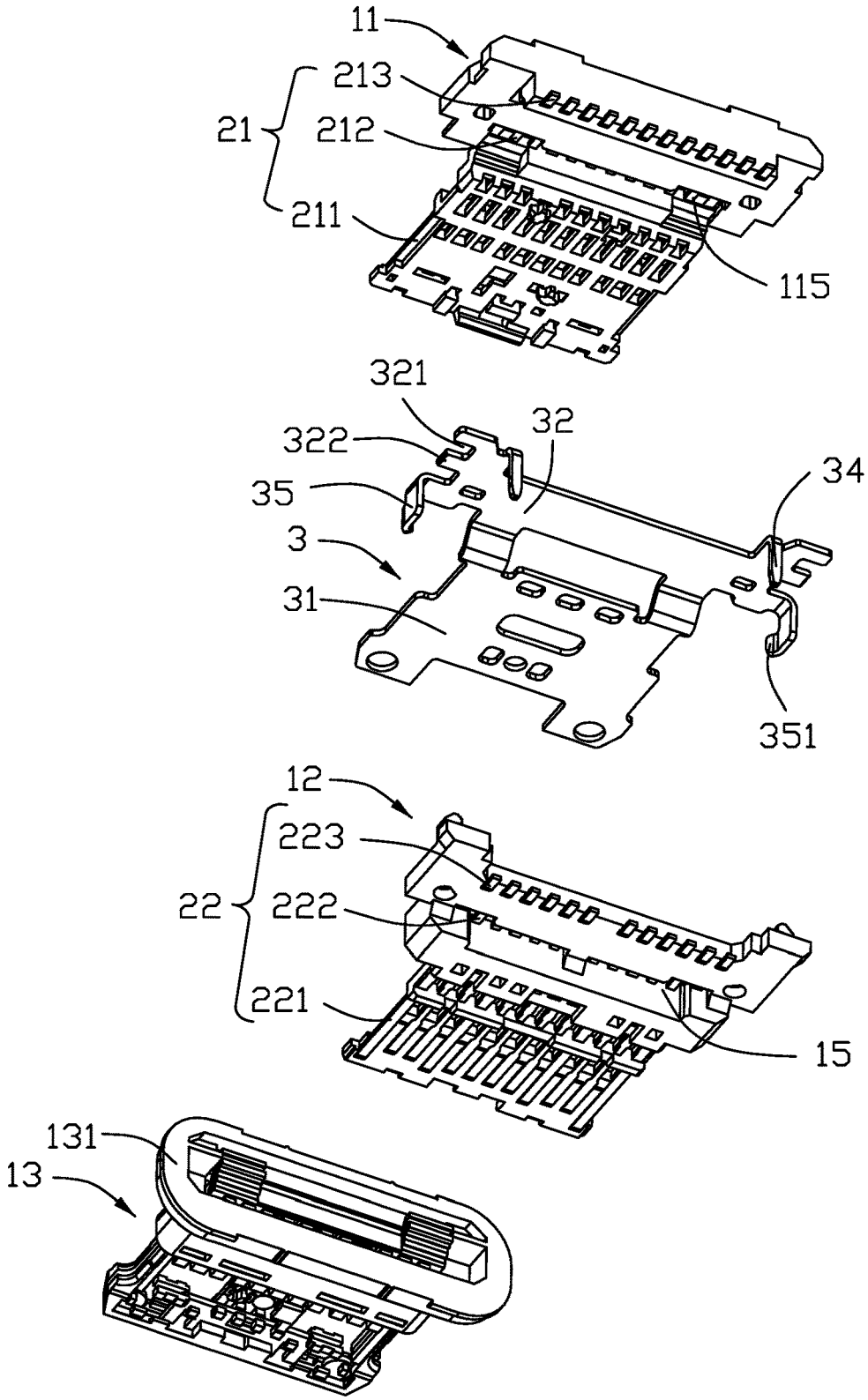
FIG. 8 is another exploded view of FIG. 6.

As shown in FIGS. 6-8, the insulative housing 1 includes insert-molded first insulative body 11, second insulative body 12, and third insulative body 13. The first insulative body 11 includes a first base portion 111 and a first tongue portion 112. The first base portion 111 has a pair of slots 113, plural holes 114, and a first perforation 115. The first tongue portion 112 has a front locking hole 116. Similarly, the second insulative body 12 includes a second base portion 121 and a second tongue portion 122. Correspondingly, the second base portion 121 has a pair of latches 123, a pair of blocks 124, and a second perforation 125, and the second tongue portion 122 has a front latch 126. The third insulative body 13 includes a third base portion 131 and a third tongue portion 132. The third tongue portion 132 has plural voids 133 for the first tongue portion 112 and the second tongue portion 122 and a pair of side slits 134. The third base portion 131 has a base section 135 proximal to the tongue portion 132 and a distal rear main section 136. The first, second, and third base portions 111, 121, and 131 constitute an overall base of the insulative housing 1. The first, second, and third tongue portion 112, 122, and 132 constitute an overall tongue of the insulative housing 1.

The plurality of contacts 2 include a row of upper, first contacts 21 mounted to the first insulative body 11 and a row of lower, second contacts 22 mounted to the second insulative body 12. The first contact 21 has a contact portion 211 exposed to an upper surface of the first tongue portion 112, a securing portion 212 partially exposed to the first perforation 115, and a soldering portion 213 extending out of the first base portion 111. Similarly, the second contact 22 has a contact portion 221 exposed to a lower surface of the second tongue portion 122, a securing portion 222 partially exposed to the second perforation 125, and a soldering portion 223 extending out of the second base portion 121.

As is well known in this art, the contact portion 221 and 222 of the first and second contacts 21 and 22 are preferably so arranged that the electrical connector 100 may accept a mating connector in dual orientations.

Figure 2:
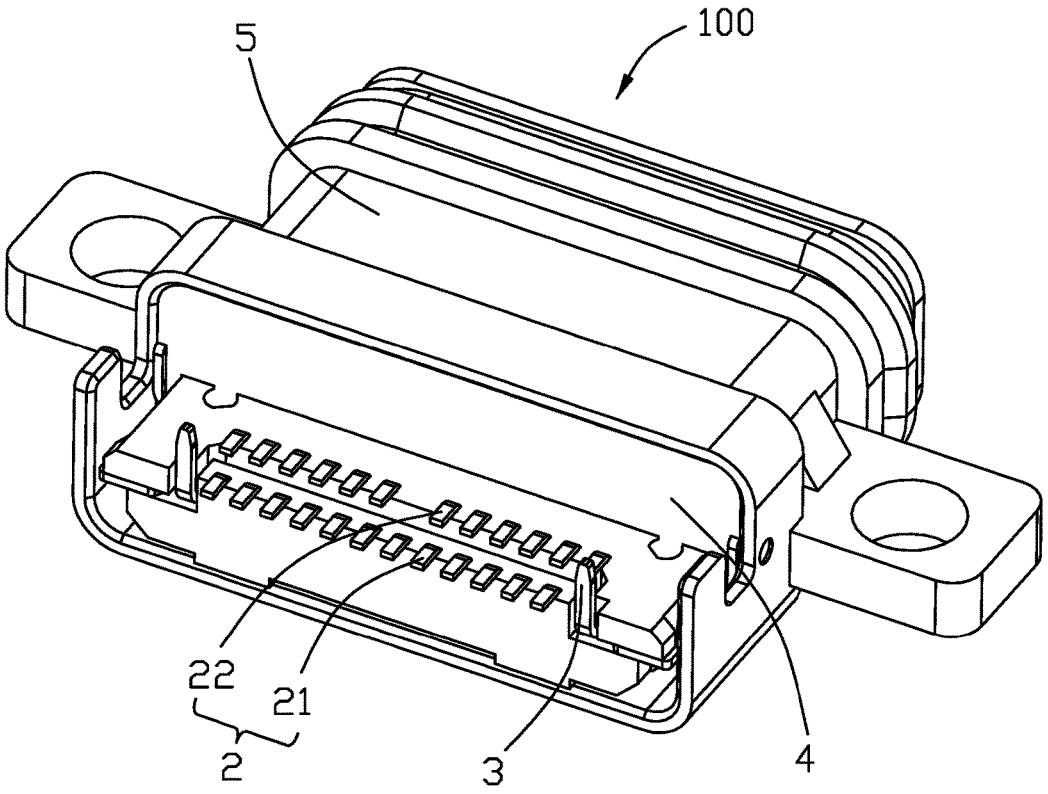
FIG. 2 is another perspective view of the electrical connector of FIG. 1.
Figure 3:
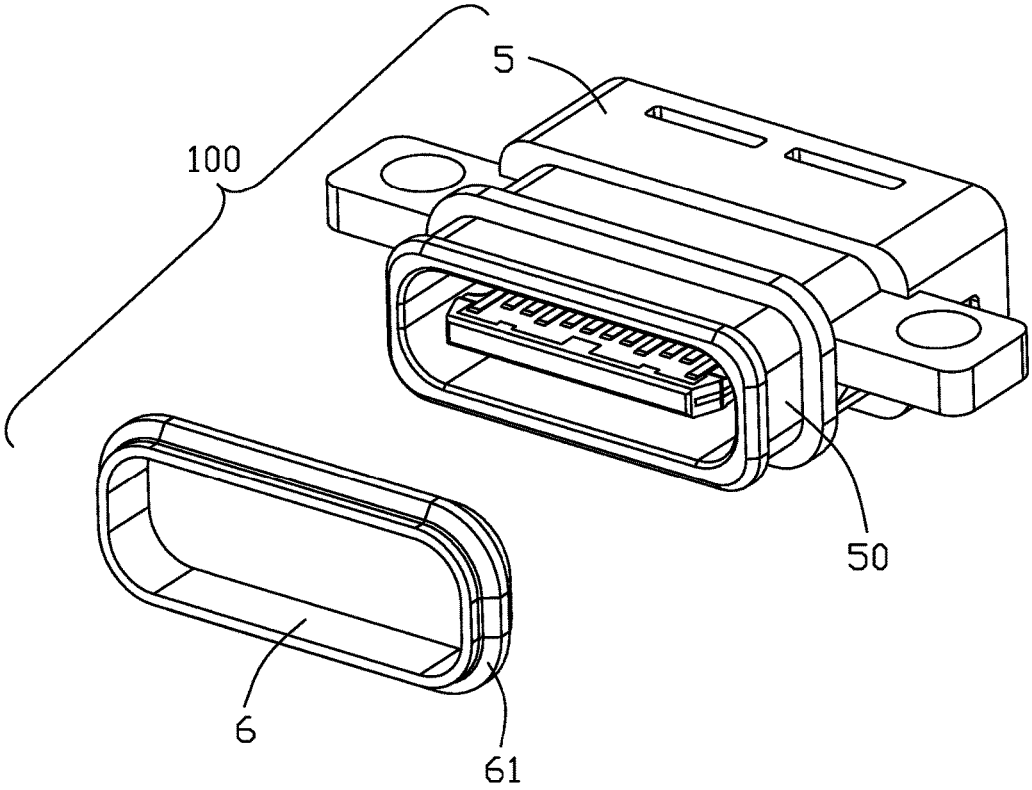
FIG. 3 is a view similar to FIG. 1 with a front seal of the electrical connector dismounted.
Figure 4:
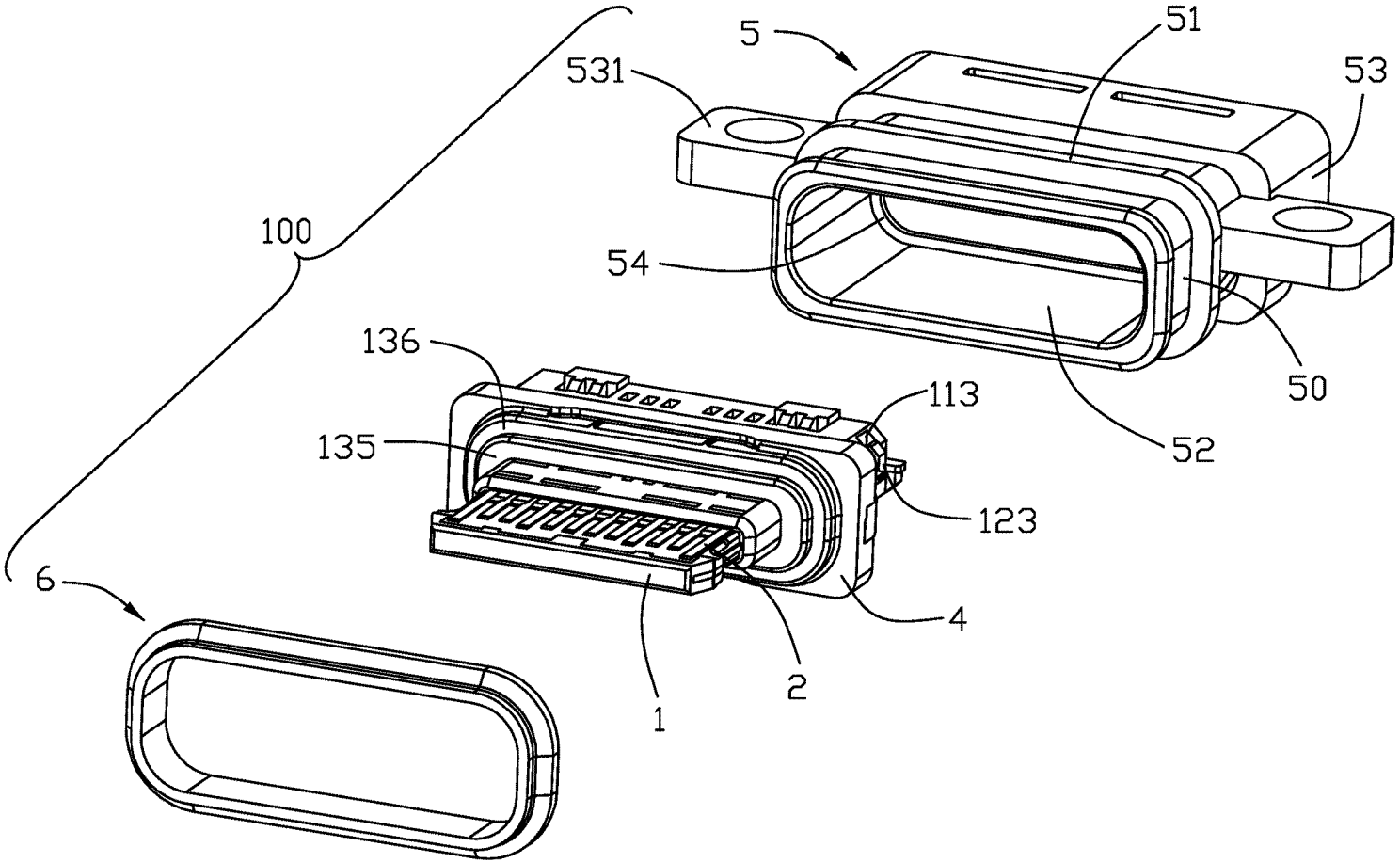
FIG. 4 is an exploded view of the electrical connector of FIG. 1.
Figure 5:
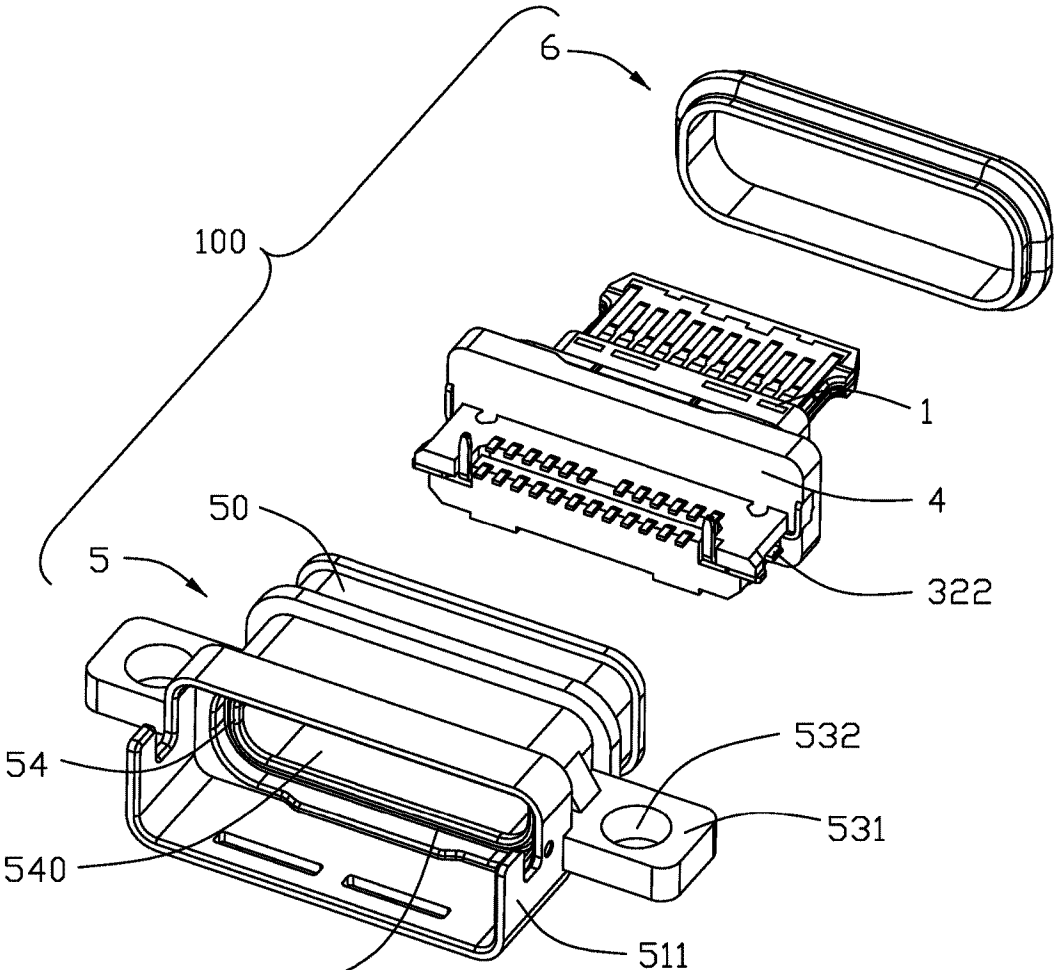
FIG. 5 is another exploded view of the electrical connector of FIG. 1.

Referring specifically to FIGS. 7 and 8, the metallic plate 3 has a first support 31 secured between the first tongue portion 112 and the second tongue portion 122, a second support 32 secured between the first base portion 111 and the second base portion 121, and a connecting portion 33 between the first support 31 and the second support 32. The connecting portion 33 has a hole 30 at a middle thereof accommodating the first insulative body 11 and the second insulative body 12 that are face to face contacting each other. The second support 32 has a pair of soldering legs 34 bent from a rear thereof and a pair of side abutments 35 near a front thereof. The side abutment 35 has a bend 351. The side abutments 35 are spot welded to an interior of the shielding shell 5 with the bends embedded inside the insulative housing 1, as can be seen in FIGS. 2 and 5. The second support 32 further has side notches 321 corresponding to the latches 123 and the slots 113 and side protrusions 322 exposed outside of the insulative housing 1.

Referring specifically to FIGS. 2, 4-5, and 9, the rear sealing element 4 is formed in place by applying and curing glues at a junction between the insulative housing 1 and the shielding shell 5. In particular, the sealing element 4 fills a space to embed the securing portions 212 of the first contacts 21 exposed to the first perforation 115 and the securing portions 222 of the second contacts 22 exposed to the first perforation 125, thereby sealing a gap between the third base portion 131 of the insulative housing 1 and the shielding shell 5.

Figure 9:
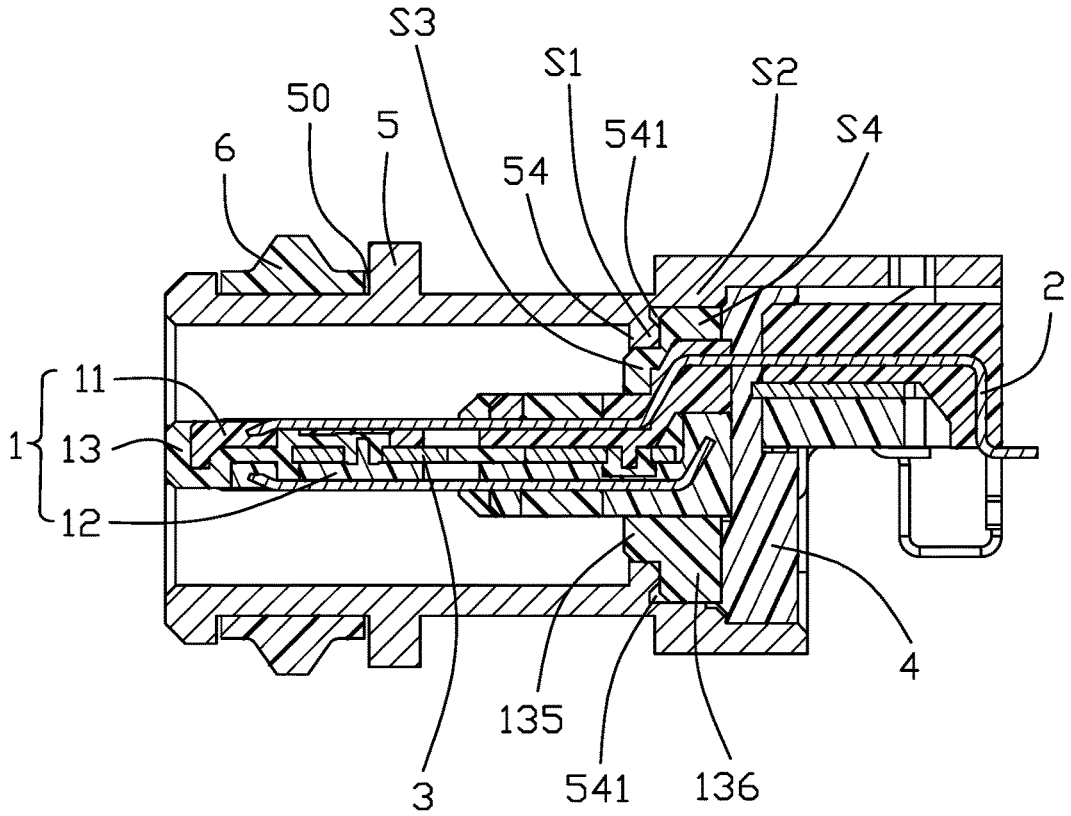
FIG. 9 is a cross-sectional view of the electrical connector taken along line A-A in FIG. 1.

Referring back to FIGS. 1-5, the shielding shell 5 has a mating opening 500 of generally rectangular shape with rounded corners and includes top and bottom walls 51 and 52 and side walls 53 between the top and bottom walls. At the outer side of the shielding shell 5 is disposed an annular seat 50 receiving the front seal 6 for waterproofing. The top wall 51 extends a longer dimension along a mating direction than the bottom wall 52. The top wall 51 has a pair of positioning legs 511 at rear lateral sides thereof. Each side wall 53 has a lug 531 with a hole 532. The shielding shell 5 has an interior annular protrusion 54 connected with the top, bottom, and side walls 51, 52, and 53. An opening 540 is defined by the protrusion 54 for the tongue of the insulative housing 1 to extend through while the protrusion 54 arrests the third base portion 131 of the insulative housing 1. A front face of the main section 136 of the insulative housing 1 abuts a rear face of the protrusion 54. With provision of the protrusion 54 or the like, in effect, the shielding shell 5 forms a rear step located immediately adjacent its junction with the insulative housing 1. Moreover, an annular recess 541 is disposed at a corner of the step. Correspondingly, the base of the insulative housing 1 includes a step on the main section 136 fitting such rear step of the shielding shell 5. The recess 541 is adapted for admitting spilled sealing material during forming the sealing element to ensure such sealing material or glue will not have access to the tongue of the insulative housing 1. The recess is preferably located forwardly of the step of the insulative housing 1. Advantageously, such rear step of the shielding shell 5 includes a horizontal part and a vertical part, and the recess 541 continues the first part into the second part. Notably, as shown in FIG. 9, the shielding shell 5 includes a front rearward step S1, which is formed by the protrusion 54, and a rear rearward step S2 which is located not only behind the front rearward step S1 in the front-to-back direction but also outside/outwardly of the front rearward step S1 in the vertical direction. Corresponding to the step S1 and the step S2 of the shielding shell 5, the housing 1 includes a front step S3 formed by the base section 135 and abutting against the front rearward step S1 in the vertical direction and forwardly communicating with the mating opening 500 in the front-to-back direction, and further includes a rear step S4 formed by the rear main section 136 and forwardly abutting against the front rearward step S1 in the front-to-back direction and abutting against the rear rearward step S2 in the vertical direction. The sealing element 4 seals a junction between the insulative housing 1 and the shielding shell 5, and located intimately behind and forwardly communicating with both the rear rearward step S2 and the rear step S4 in the front-to-back direction.

The front seal 6 is generally annular and has smooth inner surface and ridged outer surface 61.

What is claimed is:

1. An electrical connector comprising:

an insulative housing having a rear base and a front tongue;

an upper and lower rows of contacts mounted in the insulative housing and exposed to the tongue;

a shielding shell enclosing the insulative housing; and a sealing element sealing a junction between the insulative housing and the shielding shell; wherein the shielding shell includes an annular rear step located immediately adjacent the junction and a recess at a corner of the step; and the base of the insulative housing includes a step fitting the rear step of the shielding shell.

2. The electrical connector as claimed in claim 1, wherein the recess is adapted for admitting spilled sealing material during forming the sealing element.

3. The electrical connector as claimed in claim 1, wherein the recess is located forwardly of the step of the insulative housing.

4. The electrical connector as claimed in claim 1, wherein the shielding shell includes a protrusion, a rear side of the protrusion forming a part of the rear step and the recess.

5. The electrical connector as claimed in claim 1, wherein the rear step of the shielding shell includes a horizontal part and a vertical part, and the recess of the shielding shell continues the first part into the second part.

6. An electrical connector comprising:

an insulative housing having a rear base and a front tongue along a front-to-back direction;

an upper and lower rows of contacts arranged with each other in a vertical direction perpendicular to said front-to-back direction, and mounted in the insulative housing and exposed upon the tongue;

a metallic shielding shell enclosing the insulative housing, said metallic shielding shell forming an annular front rearward step and a rear rearward step which is located not only behind the front rearward step in the front-to-back direction but also outside the front rearward step in the vertical direction; and a sealing element sealing a junction between the insulative housing and the shielding shell, and located intimately behind both a rearward face of the rear base and the rear rearward step in the front-to-back direction.

7. The electrical connector as claimed in claim 6, wherein said rear base includes an inner base portion integrally formed upon the contacts via an insert-molding process, and an outer base portion integrally formed upon the inner base portion via an overmolding process, and the inner base portion is rearward offset from the outer base portion around said rearward face of the rear base.

8. The electrical connector as claimed in claim 6, wherein said shielding shell defines an opening through which the front tongue extends.

9. The electrical connector as claimed in claim 8, wherein both said outer base portion and said inner base portion extend through said opening while only said outer base portion abuts against the front rearward step.

10. The electrical connector as claimed in claim 6, wherein said shielding shell forms a recess located at an inner corner of the front rearward step and directly rearwardly facing a gap between the shielding shell and the insulative housing in the front-to-back direction so as to receive the leaked sealing element which invades through said gap.

11. The electrical connector as claimed in claim 10, wherein the base of the insulative housing includes a step abutting against the front rearward step of the shielding shell in a front-to-back direction.

12. The electrical connector as claimed in claim 1, wherein the recess is annular.

13. An electrical connector comprising:

an insulative housing having a rear base and a front tongue along a front-to-back direction;

an upper and lower rows of contacts arranged with each other in a vertical direction perpendicular to said front-to-back direction, and mounted in the insulative housing and exposed upon the tongue;

a metallic shielding shell enclosing the insulative housing, said metallic shielding shell forming a front rearward step and a rear rearward step which is located not only behind the front rearward step in the front-to-back direction but also outside the front rearward step in the vertical direction;

the housing including a front step abutting against the front rearward step in the vertical direction and forwardly communicating with the mating opening in the front-to-back direction, and further including a rear step forwardly abutting against the front rearward step in the front-to-back direction and abutting against the rear rearward step in the vertical direction; and a sealing element sealing a junction between the insulative housing and the shielding shell, and located intimately behind and forwardly communicating with both the rear rearward step and the rear step in the front-to-back direction.

14. The electrical connector as claimed in claim 13, wherein said rear base includes an inner base portion integrally formed upon the contacts via an insert-molding process, and an outer base portion integrally formed upon the inner base portion via an overmolding process, and the inner base portion is rearward offset from the outer base portion around said rearward face of the rear base.

15. The electrical connector as claimed in claim 13, wherein said shielding shell defines an opening through which the front tongue extends.

16. The electrical connector as claimed in claim 15, wherein both said outer base portion and said inner base portion extend through said opening while only said outer base portion abuts against the front rearward step.

17. The electrical connector as claimed in claim 13, wherein said shielding shell forms a recess located at an inner corner of the front rearward step and the rear rearward step, and directly rearwardly facing a gap between the shielding shell and the insulative housing in the front-to-back direction so as to receive the leaked sealing element which invades through said gap.

18. The electrical connector as claimed in claim 17, wherein the recess is annular.

* * * * *